US005313929A

United States Patent [19]

Thürk et al.

[11] Patent Number: 5,313,929

[45] Date of Patent: May 24, 1994

[54] ARRANGEMENT OF AT LEAST ONE GAS BURNER IN A MOLDED PART OF A BRITTLE-FRIABLE MATERIAL FOR EXAMPLE FOR COOKING UNITS

[75] Inventors: Jürgen Thürk, Schornsheim; Martin Taplan, Ingelheim; Roland Dudek, Mainz; Stefan Hubert, Wiesbaden; Dietrich Busch, Bacharach, all of Fed. Rep. of Germany

[73] Assignee: Schott Glaswerke, Mainz, Fed. Rep. of Germany

[21] Appl. No.: 958,261

[22] Filed: Oct. 9, 1992

[30] Foreign Application Priority Data

Oct. 9, 1991 [DE] Fed. Rep. of Germany ..... 4133409

[51] Int. Cl.[5] ..... F24C 3/00

[52] U.S. Cl. ..... 126/39 B; 126/39 R; 126/39 H; 126/214 A

[58] Field of Search ..... 126/39 R, 39 H, 39 B, 126/39 N, 214 R, 214 A

[56] References Cited

U.S. PATENT DOCUMENTS 4,971,024 11/1990 Albon et al. ..... 126/39 R
5,046,477 9/1991 Bennett et al. ..... 126/39 B

OTHER PUBLICATIONS

European patent application No. 0101002 Feb. 22, 1984, Karl Fisher.

*Primary Examiner*—Carroll B. Dority
*Attorney, Agent, or Firm*—Millen, White, Zelano, & Branigan

[57] ABSTRACT

The invention offers a simple and economical mounting possibility for gas burners in molded parts made of a brittle-friable material, such as glass, glass-ceramic or ceramic, by means of which gas burners can be mounted without stresses, in a leakage-proof and gas-tight fashion in cooking surfaces of such a material without having to impose a restriction as to a special appliance and/or a specific burner type. The molded part which is made of the brittle-friable material, is the sole support for the gas burners, however, if the molded part breaks, the gas burners will drop onto a lower metal support so that the gas feed lines do not rupture.

25 Claims, 3 Drawing Sheets

ARRANGEMENT OF AT LEAST ONE GAS BURNER IN A MOLDED PART OF A BRITTLE-FRIABLE MATERIAL FOR EXAMPLE FOR COOKING UNITS

BACKGROUND OF THE INVENTION

This invention relates to a burner arrangement, for example, for cooking units, wherein at least one gas burner is mounted in a supporting frame and the surrounding surface of the gas burner or gas burners is covered by a molded part of a brittle-friable material, such as glass, glass-ceramic or ceramic. Each gas burner extends through an opening in the molded part consisting of the brittle-friable material up to beyond the topside of the latter. Between the molded part and each gas burner, a long-term elastic junction and sealing device is provided with a junction and sealing element in contact firmly and in liquid-tight fashion with the marginal zone of the opening with at least one junction surface formed by the gas burner.

In gas ranges or bowl-shaped cooking units with a burner arrangement of this type, available on the market, the gas burners are fixedly mounted in the supporting frame or housing. A glass plate covering the surrounding surface of the gas burners is provided with an opening that is substantially larger than needed for the respective gas burner, for example with twice the diameter of the opening than the diameter of the respective gas burner. The thus-formed wide annular gap between the gas burner and the rim of the opening is covered with a ring-shaped sheet-metal collar which includes a sealing element only toward the opening rim of the glass plate but not toward the gas burner. Although a mechanical separation of the gas burner from the glass plate is thereby ensured, this manner of mounting of the gas burner within the glass plate has disadvantageous effects in practical use, especially with regard to cleaning. Thus, in these known devices, boiled-over matter can pass into the joint between the glass plate and the sheet-metal collar and run into the gap between the sheet-metal collar and the gas burner.

Therefore, cleaning of these conventional devices frequently requires at least partial disassembly.

It has been known from U.S. Pat. No. 5,046,487 to improve the seal of the burner with respect to the glass or glass-ceramic molding by making the opening of only such a size that it can accommodate the gas burner, and connecting the gas burner for sealing purposes along the opening rim firmly with the glass or glass-ceramic molding. Besides, the gas burner is attached to a crosspiece connected to the supporting frame. Such a mechanically rigid connection between a brittle-friable molded part, supporting frame, and gas burners, however, leads to the formation of distortions in the molded part under mechanical or thermal load on the cooking surfaces at the instant of stress. Depending on the structure, there may even be permanent distortions arising in the molded part. In either of the two cases, the risk of breakage of the molded part in a cooking unit or a gas range would be substantially increased.

SUMMARY OF THE INVENTION

Therefore, it is an object of this invention, in a burner arrangement of the above-discussed type, on the one hand, to provide a seal which is fully effective for practical usage between the gas burner and the molded part consisting of a brittle-friable material and, on the other hand, to exclude breakage on account of stresses; at the same time, the assembly of the burner arrangement is to be made simple and performable at low cost in time, material, and monetary expenses.

In order to solve this problem, it is suggested according to the invention that the gas burner or burners is or are carried by the molded part consisting of a brittle-friable material, and that locking and retaining means are mounted between the gas burner, either. The connection with the molded part required for supporting the gas burner or gas burners is, in accordance with this invention, of a long-term elastically resilient type. Between each gas burner and the molded part functioning as a support, there is now an adequately secure seal in order to permit a simple cleaning of the burner arrangement in practical usage. Since the gas burner or gas burners is or are carried by the molded part and have limited mobility with regard to the supporting frame of the burner arrangement, a permanent distortion of the molded part is avoided. Also, no distortion is caused by the fact that the molded part undergoes a certain elastic deformation by setting cooking utensils and the like thereon. Likewise, the molded part consisting of brittle-friable material is better suited as well for absorbing short-term stresses by articles dropped thereon, or thermal stresses during usage. In case the molded article should break during such an event, the invention offers a considerably improved structural safety for the burners and their mounting. In any case, breakage of the molded part due to distortion is precluded. On account of permitting a merely limited movability of the gas burner or gas burners with respect to the supporting frame, an effective retaining and twisting safety feature for each gas burner at the supporting frame is created for the case of breakage of the molded part consisting of brittle-friable material; such breakage can never be absolutely excluded. The only limited mobility ensures, on the one hand, that in case of failure of the supporting molded part a gas burner can drop into the interior of the supporting frame only be a limited distance so that the connection of the burner with the elastic gas feed conduit is not impaired. On the other hand, the only limited movability ensures that users of an appliance equipped with the burner arrangement according to this invention, upon breakage of the molded part, will not pull the thus-liberated gas burner or burners out of the supporting frame, or twist such burner or burners therein, thereby being liable to tear off or damage the communication of the burner with the gas feed conduit.

In total, the invention attains the objective that gas burners can be mounted almost without stresses, leakage- and gas-tight, in brittle-friable molded parts, especially in glass or glass-ceramic cooking surfaces without the need for restriction to a specific appliance or a specific burner type. The way of mounting the gas burner in the molded part in accordance with this invention is simple, and mounting can be performed with an only minor expenditure of time, material and monies.

In a preferred embodiment of the invention wherein the burner arrangement is particularly suitable for use in gas ranges and gas cooking units, the molded part consisting of a brittle-friable material is designed to be plate-shaped with respectively one passage bore for each provided gas burner, and for each passage bore and the respective gas burner a separate, long-term elastically resilient junction and sealing device is provided.

The junction and sealing device can contain, within the scope of the invention, preferably at least one annular, long-term elastically resilient junction element inserted between the marginal zone of the opening in the molded part and the junction surface formed at the gas burner. The long-term elastically resilient junction element can be a sealing ring in this arrangement, this ring being adjusted, or adjustable, by means of a tensioning means mounted at the gas burner, to a desired contact pressure.

In a simple embodiment of the invention, the long-term elastically resilient junction and sealing element is glued to the marginal zone of the opening in the molded part consisting of a brittle-friable material and to the junction surface formed at the gas burner. In this arrangement, this sealing element can consist in an annular, long-term elastic glued bond proper formed between the marginal zone of the opening in the molded part and the connecting surface at the gas burner. This long-term elastic cementing layer can be of such a thickness that it offers, on the one hand, a complete seal, especially a liquid-tight seal, between the molded part and the gas burner and, on the other hand, ensures an elastic resiliency inherent in the seat of the burner in the opening of the molded part which is also permanently elastic.

In another embodiment of the burner arrangement of this invention, the provision is made that the junction and sealing device contains two annular, long-term elastically resilient junction and sealing elements of which one is located on the topside of the plate-shaped molded part between the marginal zone of the opening and the junction surface at the gas burner and the other one of which is located on the underside of the plate-shaped molded part between the marginal zone of the opening and an annular or plate-shaped abutment member. This abutment member can be attached to the underside of the gas burner preferably by means of retaining pins.

In this embodiment of the invention, various possibilities present themselves for obtaining the desired contact force of the junction and sealing elements: For example, the desired contact force of the junction and sealing elements can be adjusted, or adjustable, by means of spacers arranged between the gas burner and the abutment member at the retaining pins, in conjunction with the thickness of the junction and sealing elements. For this purpose, a choice must be made with regard to the spacers and/or regarding the thickness of the junction and sealing elements. The spacers can also be formed on the underside of the gas burner proper in this embodiment of the invention.

Another possibility for setting the desired contact force of the connection of sealing elements resides, within the scope of this invention, in providing that the retaining pins are screw bolts threadable into the body of the gas burner, that the abutment member is displaceable on these screw bolts, and that compression springs are inserted between the head of the screw bolts and the abutment member. A desired contact pressure can be set by the choice of the compression springs and/or by selecting the length of the screw bolts. However, it is likewise possible to render the contact pressure of the junction and sealing elements adjustable by the feature that the screw bolts can be threaded into the body of the gas burner to a desired extent. Thereby, through the selected screw-in depth of the screw bolts, the spring tension and thus the contact pressure of the junction and sealing elements is adjusted.

The two junction and sealing elements provided in this embodiment can also be combined into a unit in the form of a profiled ring encompassing the rim of the opening in the molded part.

Within the scope of this invention, the locking and retaining means for the gas burner can be of an especially simple structure and thus can also permit a simple assembly of the gas burner. For this purpose, the locking and retaining means can exhibit, for example, locking pins attached to the underside of the gas burner and crosspieces arranged in the supporting frame, the locking pins extending through bores in the crosspiece and being secured from being pulled out of these bores. In an especially simple design, these locking pins can be screw bolts threaded from the bottom into the body of the gas burner and extending with their end carrying the head below the crosspiece at a spacing corresponding to the desired freedom of movement of the gas burners, the head of the screw bolts, or an inserted ring, being larger than the bore in the crosspiece.

Within the scope of the invention, the locking and retaining means for the gas burner can be integrated into its long-term elastically resilient junction and sealing device. An especially simple possibility therefor resides in that the locking pins of the securing and holding devices for the gas burner are simultaneously the retaining pins for the abutment member of the junction and sealing elements in the junction and sealing device.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
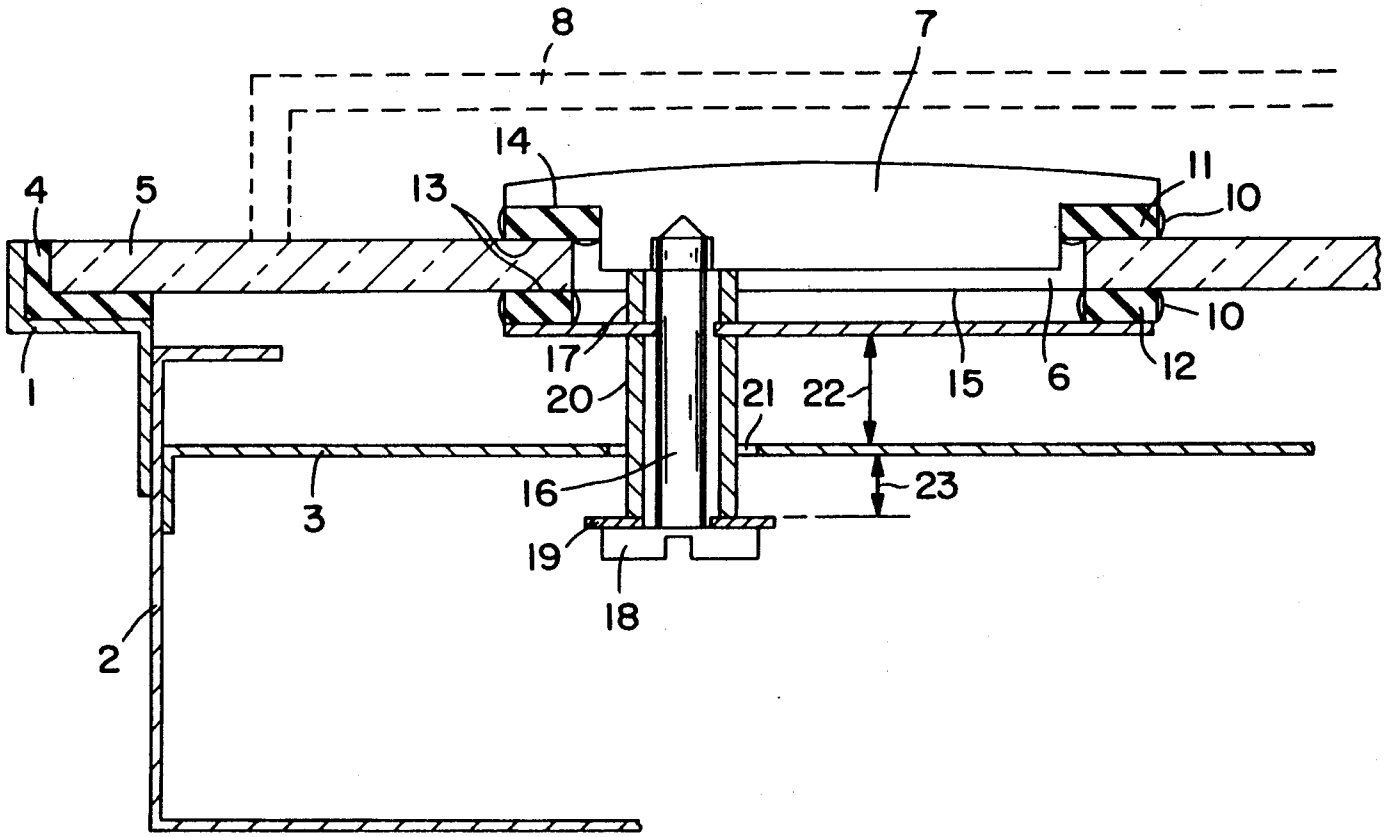
FIG. 1 shows a schematic, partial-sectional view of a bowl-shaped gas cooking unit fashioned in accordance with the invention.

In the illustrated embodiments, the bowl-shaped gas cooking unit has a supporting frame 1 with a built-in housing 2 and crosspieces 3 attached within the housing. A plate-shaped molded glass-ceramic part 5 is inserted in the supporting frame 1 and is provided with a marginal seal 4 which can be designed as a sealing profile or an injected sealing compound. The molded glass-ceramic part 5 is provided with openings 6 to accommodate, respectively, one gas burner 7. In all of the embodiments, the gas burners 7 are carried by the molded glass-ceramic part whereas the gas burners 7 exhibit limited mobility with respect to the supporting frame 1, the housing 2 and the crosspieces 3. In order to place cooking utensils on the cooking unit above one or several gas burners, pot carriers 8 are provided on the topside of the molded glass-ceramic part 5, as indicated by dashed lines in FIG. 1.

In the example of FIG. 1, the gas burner 7 is inserted, with a long-term elastically resiliently designed junction and sealing device 10, in the opening 6 of the plate-shaped molded glass-ceramic part 5. In this embodiment, the junction and sealing device 10 comprises an upper, long-term elastically resilient junction and sealing element 11 and a lower, long-term elastically resilient junction and sealing element 12, both of these being fashioned in the shape of flat sealing rings. The upper junction and sealing element 11 is here inserted on the topside of the plate-shaped molded glass-ceramic part 5 between the marginal zone 13 of the opening 6 and a junction surface 14 formed at the gas burner 7. The lower junction and sealing element 12 is inserted on the underside of the plate-shaped molded glass-ceramic part 5 between the marginal zone 13 of the opening 6 and an annular or plate-shaped abutment member 15. In this arrangement, a contact pressure of the junction and sealing elements 11 and 12 against the marginal zone 13 of the opening 6 is desired and provided in such a way that the marginal zone 13 of the opening 6 is retained gently but yet firmly in a long-term elastically resilient fashion between the two junction and sealing elements and so that, at the same time, an effective seal is ensured against boiled-over matter, especially liquid, on the topside of the molded glass-ceramic part 5 and on the junction surface 14 of the gas burner 7. This contact force is adjusted, in the example of FIG. 1, by the feature that the annular or plate-shaped abutment member 15 is held firmly from below against the gas burner 7 by means of a plurality of retaining pins 16 distributed all around. In this arrangement, the distance of the abutment member 15 from the junction surface 14, determining for the contact pressure in conjunction with the thickness of the junction and sealing elements 11, 12, is set by a spacer ring 17 inserted between the underside of the gas burner 7 and the abutment member 15 on each retaining pin 16. In the embodiment of FIG. 1, the retaining pins 16 are screw bolts with a bolt head 18. In order to attach the abutment member 15, the retaining pin 16 carries above the bolt head 18 a shim (e.g. washer or inserted ring) 19 and a small spacer tube 20 supporting itself against the abutment member 15.

The retaining pins 16 with the small spacer tubes 20 extend from the abutment member 15 through bores 21 arranged in the crosspiece 3 to below the crosspiece 3, the bolt head 18 or at least the shim 19 exhibiting a larger diameter than the bore 21. On account of this arrangement and due to the fact that the gas burner 7 is connected to the valve unit by means of flexible conduits, the gas burner 7 exhibits limited mobility with respect to the supporting frame 1 and, respectively, the housing 2 and the crosspiece 3. Any deformations evoked by thermal effects or by the weight of the emplaced pots and the like at the molded glass-ceramic part 5 are absorbed by this limited mobility so that no distortion whatever is caused in the glass-ceramic molding 5 by the mounting of the gas burners 7. However, in case the molded glass-ceramic part 5 is broken and fails, after all, for some reason, then the gas burner 7 can move downwards merely by the distance 22 of the abutment member 15 to the crosspiece 3. If the user of the cooking unit, upon breaking of the molded glass-ceramic part 5, wants to pull the gas burner 7 out in the upward direction, this movement is restricted by abutment of the shim 19 against the underside of the crosspiece 3. Accordingly, a lifting motion is possible merely by the distance 23 between the crosspiece 3 and the shim 19. The dropping motion as well as the raising motion can be absorbed by the flexible feed conduit to the gas burner 7 without endangering its connection to the gas burner 7 and the valve unit (not illustrated). In case of a possible breakage of the molded glass-ceramic part 5, twisting of the gas burner 7 is possible only within the extent of play exhibited by the small spacer tube 20 in the bore 21 of the crosspiece 3. Such a limited twist likewise fails to endanger the connections of the feed conduit to the burner 7.

Figure 2:
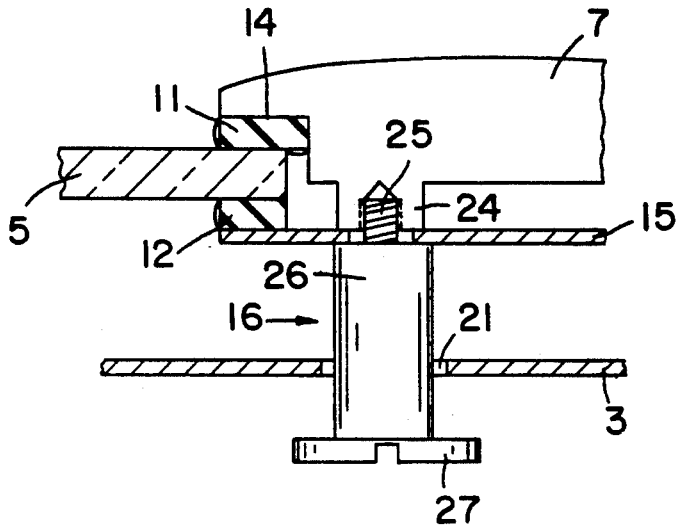
FIG. 2 is a schematic, partial-sectional view of a modified embodiment of a bowl-shaped gas cooking unit.

In the example of FIG. 2, the basic structure of the cooking unit is the same as that in the embodiment of FIG. 1. In this case, for establishing the distance between the junction surface 14 of the gas burner 7 and the abutment member 15, governing for the contact force of the junction and sealing elements 11 and 12, the gas burner 7 is designed on its underside with cylindrical projections 24 or with a corresponding projection ring. The retaining pins 16 in this example are retaining bolts with an offset threaded section 25 so that they are placed, with their thicker bolt portion 26, from below against the abutment member 15 when the threaded section 25 is threaded into the projections 24, and affix this abutment member on the underside of the projections 24 to the gas burner 7. The retaining pins 16 in this example exhibit an enlarged, plate-shaped head 27; since the retaining pins 16 extend downwards through bores 21 of the crosspiece 3, and their plate-shaped head 27 has a larger diameter than the bores 21, the same restriction of movement of the gas burner 7 with respect to the supporting frame 1 and/or the housing 2 and the crosspieces 3 of the cooking unit is obtained in the embodiment of FIG. 2.

In the embodiments of FIG. 1 and FIG. 2, a simple way of mounting the gas burners 7 in the cooking bowl unit is ensured. After insertion of the plate-shaped molded glass-ceramic part 5 in the supporting frame 1, the gas burners 7 are to be inserted in the openings 6 with interposition of the upper junction and sealing elements 11. From the underside, the abutment member 15 with the lower junction and sealing element 12 placed thereon is to be applied and to be affixed with the retaining pins 16 passed through the bores 21 of the crosspiece 3; in the example of FIG. 2, a further facilitating feature resides in that the placement of the spacer rings 17 and small spacer tubes 20 is eliminated.

Figure 3:
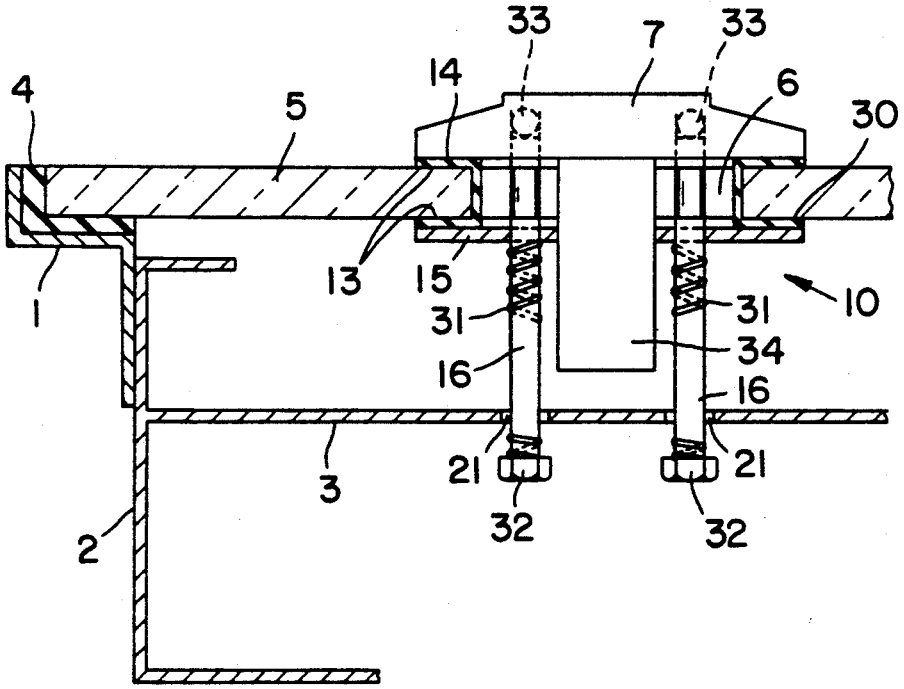
FIG. 3 shows a schematic, partial-sectional view of a further embodiment of a bowl-shaped gas cooking unit fashioned in accordance with the invention.

In the embodiment of FIG. 3, the basic structure of the bowl-shaped gas cooking unit is the same as that of the bowl-shaped cooking unit according to FIG. 1. However, in place of the separate junction and sealing elements, the junction and sealing device 10 in this example exhibits a profiled ring combining both junction and sealing elements into one unit; this ring encompasses the marginal zone of the opening 6. The body of the gas burner 7 is attached with its annular connecting surface on the upper leg of this profiled ring while the abutment member 15 is urged from below against the lower leg of the profiled ring 30. The contact force of the upper leg of the profiled ring 30 against the marginal zone 13 of the opening 6 and against the junction surface 14 of the gas burner 7 is produced in this embodiment by compression springs 31 inserted between the head 32 of each of the retaining pins 16 fashioned as screw bolts and the abutment member 15. As indicated by dotted lines in FIG. 3, the threaded bores 33 in the body of the gas burner 7 are of sufficient length for being able to thread the retaining pins 16, designed as screw bolts, in place to a more or less large extent. Thereby, the long-term elastically resilient pressure exerted by the compression springs 31 on the underside of the abutment member 15 can be adjusted, depending on the insertion depth of the retaining pins 16 threaded into the body of the gas burner 7. Correspondingly, the contact pressure of the upper leg of the profiled ring 30 against the marginal zone 13 of the opening 6 in the molded glass-ceramic part 5 and against the junction surface 14 of the gas burner 7 will be set in the same way.

Also in this embodiment, the gas burners 7 exhibit limited mobility with regard to the supporting frame 1, the housing 2 and the crosspiece 3. In case of failure, for example breakage, of the molded glass-ceramic part 5, the provided gas burners 7 can drop downwards by such an extent that they come into contact, with a bottom extension 34 mounted thereto, with the crosspiece 3 in the interior of the housing 2. The extension 34 arranged on the underside of the gas burners 7 thus constitutes an additional limitation for the downward movement of the gas burners 7 taking place upon breakage or some other failure of the molded glass-ceramic part 5. The upward movement of the gas burners 7 which becomes possible upon failure of the molded glass-ceramic part 5 is limited by the heads 32 of the retaining pins 16 since these heads 32 are larger than the bores 21 in the crosspiece 3. A twisting of the gas burners 7 which may become possible upon elimination of the molded glass-ceramic part 5 is very narrowly limited to the clearance of the retaining pins 16 in the bores 21 of the crosspiece 3. By this restriction of the movability, any danger regarding the connections of the feed conduits to the gas burners 7 is excluded, as in the embodiments of FIGS. 1 and 2.

The embodiment of FIG. 3 likewise presents an especially simple possibility of assembly. The insertion of the profiled rings 30 in the openings 6 of the molded glass-ceramic part 5 is effected prior to insertion of the burners 7, optionally prior to insertion of the molded glass-ceramic part 5 in the supporting frame 1. Then it is merely necessary to place the gas burners 7 in the openings 6 and set them with their junction surface 14 on the topside of the upper leg of the profiled rings 30. The abutment member 15 is to be applied from the bottom, and then it is only necessary to pass the retaining pins 16 with the attached compression springs 31 through the bores 21 of the crosspiece 3, from there through the bores of the abutment member 15, and into the threaded bores 33 in the body of the gas burner 7 with the desired depth.

Figure 4:
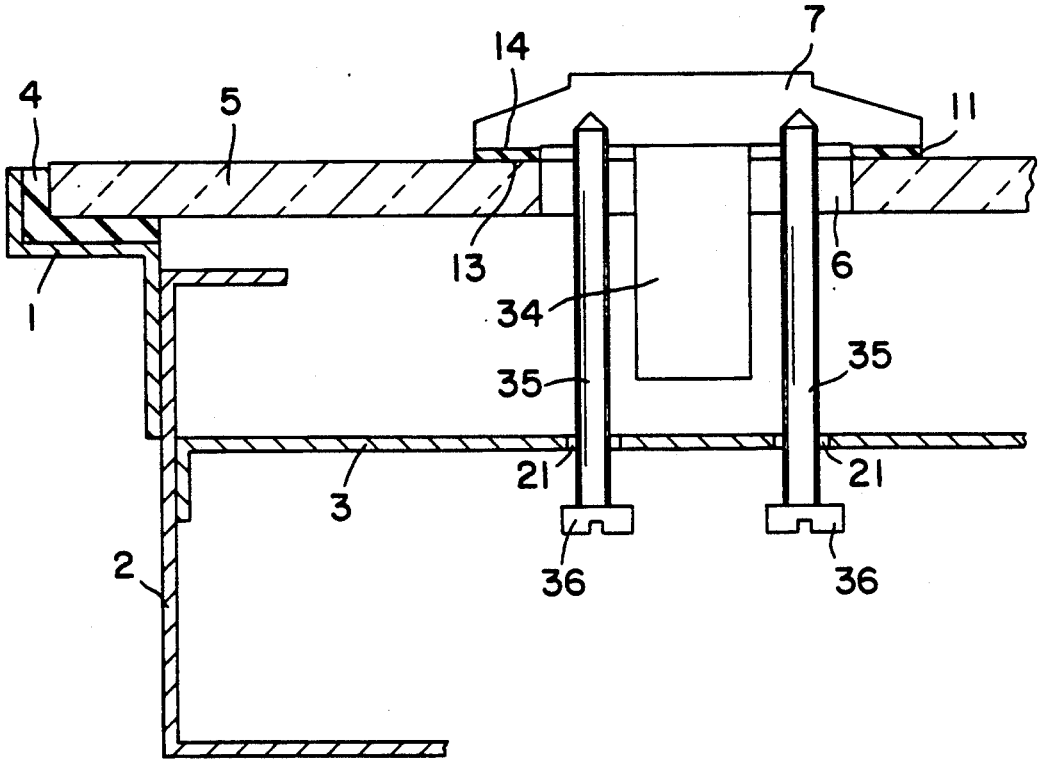
FIG. 4 is a partial sectional view of a fourth embodiment of a bowl-shaped gas cooking unit according to this invention.

In the embodiment of FIG. 4, again the same basic structure of the bowl-shaped gas cooking unit is provided as in the example of FIG. 1, but the junction and sealing device in this embodiment is substantially simplified by the feature that only an upper junction and sealing element 11 is provided, glued as a flat sealing ring of a long-term elastically resilient material onto the topside of the molded glass-ceramic part 5 in the marginal zone 13 of the opening 6. Furthermore, the junction and sealing element 11 is also cemented to the junction surface 14 of the gas burner 7. As in the examples of FIGS. 1 through 3, the gas burner 7 is supported solely by the plate-shaped glass-ceramic molding 5. There is no additional mounting of the gas burner 7 to the supporting frame 1, the housing 2 and the crosspiece 3. In order to secure the gas burner 7 upon failure of the glass-ceramic molding 5, locking pins 35 are provided taking the place of the retaining pins 16 provided in the embodiments according to FIGS. 1–3. The locking pins 35, in the illustrated example, are likewise screw bolts with heads 36 and extend through bores 21 in the crosspiece 3. In this case, the bores 21 are smaller than the heads 36 of the locking pins 35. On account of their clearance in the bores 21 of the crosspiece 3 and due to the fact that they extend with their heads 36 downwardly past the crosspiece 3, the locking pins 35 do not in any way constitute fastening elements of the gas burner 7 at the supporting frame 1 or at the housing 2 and the crosspiece 3.

In case of breakage or other failure of the molded glass-ceramic part 5, the gas burner 7 can move downwards by a certain extent until a bottom extension 34 impinges on the crosspiece 3. An upward movement, for example when an attempt is made to lift the gas burner 7 out, is restricted by the feature that the heads 36 of the locking pins 35 impinge on the crosspiece 3 from below. In case of an attempt to twist the gas burner 7, the movement is restricted to the play of the locking pins 35 in the bores 21. In any event, a flexible connection conduit from the gas burner to the gas valve is protected and, in particular, also secured against detachment of its junction points. The assembly of the gas burner 7 is especially simple. The junction and sealing element 11 can be glued to the connecting surface 14 of the gas burner 7 as early as prior to assembly. After insertion of the molded glass-ceramic part 5 in the supporting frame 1, the glue bond to join the junction and sealing element 11 to the marginal zone 13 of the opening is then to be prepared, and the gas burner 7 is to be inserted and to be provided with the locking pins 35 passed through the bores 21 of the crosspiece 3. Mounting of the locking pins 35 can be done prior to or simultaneously with the cementing of the junction and sealing element 11 in the marginal zone 13 of the opening.

REFERENCE SYMBOLS:

| | |
|---|---|
| 1 supporting frame | 19 shim |
| 2 housing | 20 small spacer tube |
| 3 crosspiece | 21 bore |
| 4 seal | 22 distance |
| 5 molded glass-ceramic part | 23 distance |
| 6 opening | 24 projections |
| 7 gas burner | 25 thread section |
| 8 cookware support | 26 thick bolt portion |
| 10 junction and sealing device | 27 plate-shaped head |
| 11 upper junction and sealing element | 30 profiled ring |
| 12 lower junction and sealing element | 31 compression spring |
| 13 marginal zone of 6 | 32 head |
| 14 junction surface | 33 threaded bore |
| 15 abutment member | 34 lower extension |
| 16 retaining pin | 35 locking pin |
| 17 spacer ring | 36 head |
| 18 bolt head | |

The entire disclosures of all applications, patents and publications, cited above and below, and of corresponding application German No. P 41 33 409.4, filed Oct. 9, 1991, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A burner arrangement useful in cooking units, wherein at least one gas burner is mounted in a supporting frame and surrounded by a molded part of a brittle-friable material having a topside; wherein each gas burner extends through an opening in the molded part of the brittle-friable material up to and beyond the topside of the molded part, and wherein, between the molded part and each gas burner, an elastic junction and sealing device is provided with a junction and sealing element in firm contact and in liquid-tight engagement with a marginal zone of the opening and with at least one junction surface formed by the gas burner; the improvement comprising the gas burner (7) being carried by a molded part (5), the molded part (5) being in the form of a plate made of a brittle-friable material, locking means (16 or 35) for fixing the gas burner (7) to the molded part (5) and retaining means (3) secured to the frame (2) beneath the molded part (5) and spaced from the molded part (5), the retaining means (3) being out of direct mechanical contact with the molded part (5), the gas burner (7) and the locking means (16 or 35); wherein the retaining means will support the gas burner (7) upon breakage of the molded part (5) while allowing the burner (7) to move and twist with respect to the molded part (5) under normal circumstances whereby stresses in the molded plate (5) due to the thermal and mechanical loading by the burner (7) are minimized.

2. The improvement of claim 1, wherein the burner (7) is retained in the opening (6) of the molded part (5) by a screw (16) which cooperates with a plate (15) to clamp the burner to the molded part, the screw (16) having a head portion (18) extending through an opening (21) in the retaining means (3) for access, the screw being out of mechanical engagement with the molded part (5).

3. The burner arrangement according to claim 2, wherein the molded part (5) consisting of the brittle-friable material is configured as plate-shaped support with one opening (6) for the gas burner (7).

4. The burner arrangement according to claim 3, wherein the junction and sealing element (11) is inserted between a marginal zone (13) of the opening (6) in the molded part (5) and an annular junction surface (14) formed on the gas burner (7).

5. The burner arrangement according to claim 4, wherein sealing element (11) is a sealing ring which is adjusted, or is adjustable, to the desired contact force by means of a tensioning device (15, 16) including said locking means mounted proximate the gas burner (7).

6. The burner arrangement according to claim 1, wherein the sealing element (11) is adhered to the marginal zone (13) of the opening (6) in the molded part (5) and to a junction surface (14) formed on the gas burner (7).

7. The burner arrangement according to claim 6, wherein the sealing element (11) includes an annular, long-term elastic glue bond formed between the marginal zone (13) of the opening (6) in the molded part (5) and the junction surface (14) on the gas burner (7).

8. The burner arrangement according to claim 4, wherein the junction and sealing device (10) contains two annular, long-term elastically resilient junction and sealing elements (11 and 12), one of which (11) is positioned on the topside of the plate-shaped molded part (5) between the marginal zone (13) of the opening (6) and the junction surface (14) on the gas burner (7), and the other one of which (12) is positioned on the underside of the plate-shaped molded part (5) between the marginal zone (13) of the opening (6) and an annular abutment member (15).

9. The burner arrangement according to claim 8, wherein the abutment member (15) is attached to the underside of the gas burner (7) by spacer tubes about retaining pins (16) which produce the contact force of the junction and sealing elements (11, 12) at the molded part (5) in the marginal zone (13) of the opening (6).

10. The burner arrangement according to claim 9, wherein the desired contact force of the junction and sealing elements (11, 12) is adjustable by spacers (17) provided between the gas burner (7) and the abutment member (15) at the retaining pins (16), in conjunction with the thickness of the junction and sealing elements (11, 12).

11. The burner arrangement according to claim 10, wherein the spacers (17) are provided on the underside of the gas burner (7).

12. The burner arrangement according to claim 8, wherein the retaining pins (16) are screw bolts threadable into the body of the gas burner (7), an abutment member (15) being displaceable on these screw bolts; and compression springs (31) being inserted between heads (32) of the screw bolts and the abutment member (15).

13. The burner arrangement according to claim 12, wherein the screw bolts can be threaded into the body of the gas burner (7) with a depth of a desired dimension.

14. The burner arrangement according to claim 8, wherein the two junction and sealing elements are combined in a unit in the shape of a profiled ring (30) encompassing the rim of the opening (6) in the molded part (5).

15. The burner arrangement according to claim 1, wherein the locking and retaining means comprise locking pins (16, 35) mounted to the underside of the gas burner and crosspieces (3) mounted in the supporting frame (1, 2), the locking pins (16, 35) extending through bores (21) in the crosspieces (3).

16. The burner arrangement according to claim 15, wherein the locking pins (16, 35) are screw bolts threaded from below into the body of the gas burner (7), the bolts extending with ends carrying heads positioned underneath the crosspieces (3) at a distance corresponding to the desired freedom of movement of the gas burner (7), the heads (18, 27, 32, 36) of the screw bolts being larger than the bores (21) in the crosspieces (3).

17. The burner arrangement according to claim 9, wherein the retaining pins (16) for the abutment member (15) of the junction and sealing elements (11, 12) also provide the locking pins for the gas burner (7).

18. The burner arrangement according to claim 9, wherein the retaining pins (16) are screw bolts threadable into the body of the gas burner (7); the abutment member (15) is displaceable on these screw bolts; and compression springs (31) are inserted between heads (32) of the screw bolts and the abutment member (15).

19. The burner arrangement according to claim 8, wherein the desired contact force of the junction and sealing elements (11, 12) is adjustable by spacers (17) provided between the gas burner (7) and the abutment member (15) at the retaining pins (16), in conjunction with the thickness of the junction and sealing elements (11, 12).

20. The burner arrangement of claim 1, wherein there are a plurality of burners (7).

21. The burner arrangement of claim 20, wherein the molded part (5) is configured as a plate-shaped support with one opening (6) for each gas burner (7), and wherein there are further included separate, long-lived, elastically-resilient, junction seals disposed between the gas burners (7) and the molded part (5).

22. The burner arrangement according to claim 21, wherein the junction seals have a leakage-tight adjustable contact force provided by junction and sealing elements (11) against marginal zones (13) of the opening (6) in the molded part (5) and junction surface (14) of the gas burner (7).

23. The burner arrangement according to claim 22, wherein sealing elements (11) are sealing rings which are adjustable to the desired contact force by the locking means.

24. The burner arrangement according to claim 23, wherein annular abutment members (15) are attached to the undersides of the gas burners (7) by said locking means which includes retaining pins (16) which produce the contact force of the junction and sealing elements (11, 12) at the molded part (5) in the marginal zone (13) of the opening (6).

25. The burner arrangement of claim 1, wherein the brittle-friable material is selected from the group consisting of glass ceramic and ceramic.

* * * * *